US006962278B2

(12) United States Patent
Obatake

(10) Patent No.: US 6,962,278 B2
(45) Date of Patent: Nov. 8, 2005

(54) PAINTBALL HARNESS

(75) Inventor: Derrick Shigeo Obatake, Torrance, CA (US)

(73) Assignee: Dye Precision, Inc., San Diego, CA (US)

( * ) Notice: Subject to any disclaimer, the term of this patent is extended or adjusted under 35 U.S.C. 154(b) by 192 days.

(21) Appl. No.: 10/352,634

(22) Filed: Jan. 28, 2003

(65) Prior Publication Data

US 2004/0144823 A1 Jul. 29, 2004

Related U.S. Application Data

(60) Provisional application No. 60/353,357, filed on Feb. 1, 2002.

(51) Int. Cl.[7] ..... A45F 5/00

(52) U.S. Cl. ..... 224/681; 224/683; 224/250; 224/901.4; 224/931

(58) Field of Search ..... 224/660, 665, 224/680–684, 242, 245, 250, 251, 901.2, 901.4, 904, 931

(56) References Cited

U.S. PATENT DOCUMENTS

| | | | | | |
|---|---|---|---|---|---|
| 4,085,872 | A | * | 4/1978 | Foo | 224/223 |
| 4,449,654 | A | * | 5/1984 | Cappis | 224/684 |
| 4,613,068 | A | * | 9/1986 | Bianchi | 224/660 |
| 4,836,427 | A | * | 6/1989 | McManus | 224/684 |
| 5,240,156 | A | * | 8/1993 | Sicotte et al. | 224/901.8 |
| 5,413,262 | A | * | 5/1995 | Dewire et al. | 224/901.4 |
| 5,443,192 | A | | 8/1995 | Hodges et al. | 224/253 |
| 5,693,006 | A | | 12/1997 | Slautteback | 602/19 |
| 5,702,042 | A | | 12/1997 | Peacock | 224/662 |
| 6,158,642 | A | * | 12/2000 | Herbage | 224/684 |
| D483,561 | S | * | 12/2003 | Charpentier | D3/221 |
| 6,729,497 | B2 | * | 5/2004 | Rice et al. | 220/835 |
| 2002/0084295 | A1 | * | 7/2002 | Martindale et al. | 224/665 |
| 2004/0031836 | A1 | * | 2/2004 | Garcia | 224/682 |

OTHER PUBLICATIONS

JT USA Paintball 2003 PROHARNESS™ <http://www.j-tusa.com/03proharness.asp> Jan. 9, 2003 [web page].

* cited by examiner

*Primary Examiner*—Nathan J. Newhouse
(74) *Attorney, Agent, or Firm*—Richard D. Clarke

(57) ABSTRACT

The harness of the present invention comprises a unitary waist-encircling supportive belt of largely elastic fabric adapted to receive and securely hold various numbers of paintball pods. A plurality of fabric layers are positioned to form a honeycomb of hollow pockets which, together with pod retainer clips, assume the configuration of, and securely hold, inserted paintball pods. The resulting configuration will accommodate a plurality of paintball pods of varying circumference, and affords the advantage that, as the wearer exhausts and discards pods in the course of a paintball game, the pockets collapse, the belt contracts, and the wearer becomes less encumbered.

12 Claims, 3 Drawing Sheets

PAINTBALL HARNESS

CROSS-REFERENCE TO RELATED INVENTIONS

This application claims benefit of Provisional Application No. 60/353,357, filed Feb. 1, 2002, the contents of which are incorporated by reference.

FIELD OF THE INVENTION

The present invention relates to a harness carrier and, in particular, to a harness carrier in the form of a waist-encircling belt means adapted to accommodate a variable number of paintball pods.

BACKGROUND OF THE INVENTION

The ability to easily carry articles in a "hands-free" manner is especially desirable in activities such as bicycling, hiking, skiing, skating and, in particular, the sport of paintball. The game of paintball has enjoyed great success in recent years. In the game, each one of two or more teams tries to capture the opposing team's flag. The players on the teams each carry a carbon dioxide powered gun that shoots paintballs—gelatin covered spherical capsules which contain a colored liquid—a considerable distance. When a player is hit with a paintball fired from a gun, the paintball ruptures and leaves a colored "splat" on the hit player who is then "out" and must leave the game. Since optimizing the number of opponents hit is the underlying concept, any means of attenuating sound indicating the location of a player, or diminishing the dimensions of the target presented, are advantageous. Depending on the size of the field and the number of players, paintball games usually have a time limit. During this time period, each team tries to capture the opposing team's flag. Victory occurs when a player successfully carries the captured flag back to his or her team's flag station and hangs it.

The players of this sport must carry pods containing paint to refill their paintball guns while playing. The paint-filled pods can be heavy, inasmuch as pods comprise canisters with flip-up lids and may carry sufficient paint to provide up to one hundred forty (140) rounds. Thus, the harness used for paintball should be sturdy, capable of carrying much weight, and provide good back support to the user. At the same time, it is important that the harness not interfere with the user's mobility and flexibility in the upper body and arms. Additionally, another consideration with paintball harnesses is that the players may want to carry differently sized pods depending on the game and, therefore, automatically accommodate pods of varying dimensions. Consequently, it would be advantageous to have a harness that provides good back support, does not interfere with the user's mobility, and automatically accommodates the transport of different numbers or sizes of pods.

Numerous means of transporting paintball pods are known, some utilizing supportive belts in combination with various sized compartments. U.S. Pat. No. 5,240,156, Modular Component System, issued Aug. 31, 1993, discloses a modular system of interchangeable compartments mounted on a support member such as a belt by a looped weave-hook system like VELCRO. The compartment modules may be removed from the support surface by forceable disengagement. A typical compartment and belt combination is shown in U.S. Pat. No. 5,443,192, Belt-Mounted Detachable Holster for Holding A Chemical Deterrent Canister, issued Aug. 22, 1995 to Hodges et al. U.S. Pat. No. 5,702, 042, Harness Carrier, issued Dec. 30, 1997 to Peacock discloses a back harness comprising a flexible or semi-rigid material such as polyethylene or laminated board, attached to the outside of which is a container or means for supporting one or more containers. And U.S. Pat. No. 6,158,642, Modular Carrier Assembly Adapted for Paintball, issued Dec. 12, 2000, discloses a carrier assembly comprised of a belt portion and a pack portion that are readily attachable and detachable from each other.

Accordingly, it is an object of the present invention to provide a unitary harness carrier for accommodating the transport of a variable number of paintball pods, irrespective of dimension;

Another object is to provide a harness carrier, the external dimensions of which decrease as the paintball pods transported therein are discarded;

A further object is to provide a paintball pod carrier enabling rapid pod removal with minimal physical motion and sound;

And yet, a further object is to provide a unitary harness carrier for paintball pods in the form of belt means adapted to securely retain paintball pods utilizing flip-up lids until removal of pods for use in association with a paintball gun.

BRIEF SUMMARY OF THE INVENTION

The harness of the present invention comprises a unitary waist-encircling supportive belt of largely fabric adapted to receive and securely hold various numbers of paintball pods. An inner layer of elastic fabric is joined at the outer ends thereof to connect with first and second flaps extending outwardly in opposite directions and which terminate in a VELCRO fastening system. A plurality of retainer clips are equidistantly arranged on the outer surface of said inner layer, said retainer clips and inner fabric layer being secured by rivets passing therethrough. An intermediate layer of elastic material, longer in length but shorter in height than said inner layer is arranged upon said inner layer at its outer surface, and is secured at junction points and at intermediate points on the inner layer's outer surface, between the locations of said retainer clips, to form, hollow pockets which, together with said clips, are adapted to assume the configuration and securely hold inserted paintball pods. An outer layer of elastic fabric, joined at its outer ends with connecting with first and second flaps extending outwardly in opposite directions and terminating in VELCRO hooks, is longitudinally secured to the exterior surface of each hollow pocket at an intermediate position thereon, thereby forming a plurality of additional hollow pockets formed by the second outer layer and the exterior surface of said intermediate layer arranged on the outer surface of the inner layer. The resulting configuration will accommodate a plurality of paintball pods and affords the advantage that, as the wearer exhausts and discards pods, the belt tends to contract and the wearer becomes less encumbered.

BRIEF DESCRIPTION OF THE DRAWINGS

For a better understanding of the invention, an exemplary embodiment is described below, considered together with the accompanying drawings in which.

PRESENTLY PREFERRED EMBODIMENT

Figure 1:
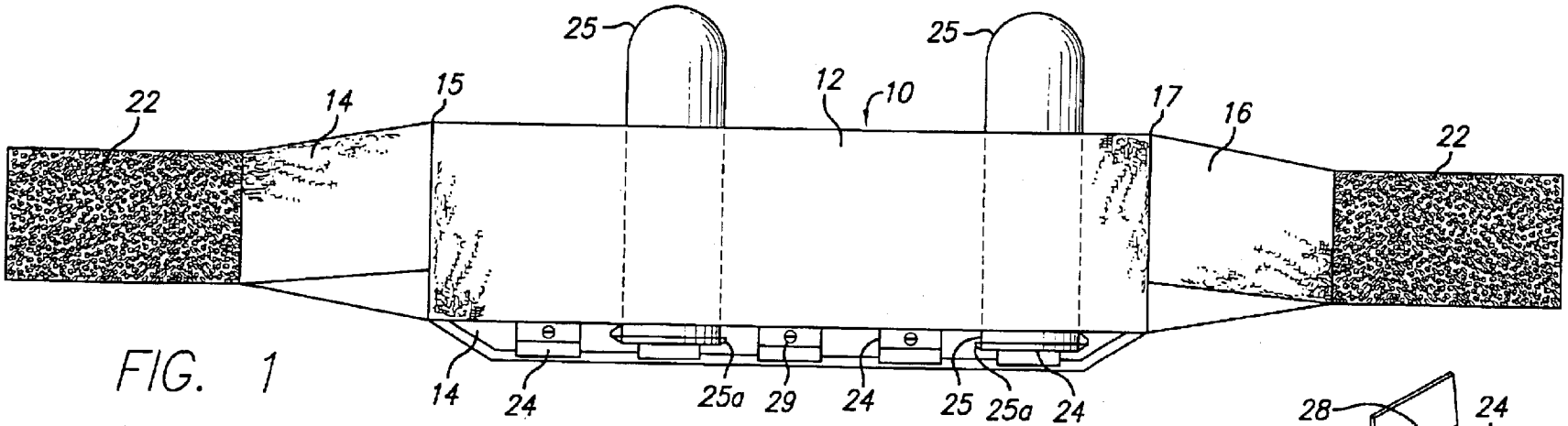
FIG. 1 schematically shows a front view of the exterior surface of the harness belt with paintball pods inserted.
Figure 1A:
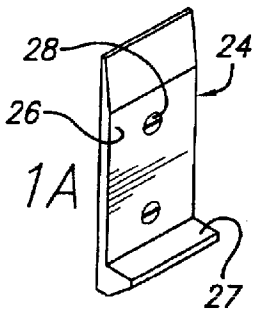
FIG. 1A illustrates the structure of retainer clips incorporated into the harness belt.
Figure 2:
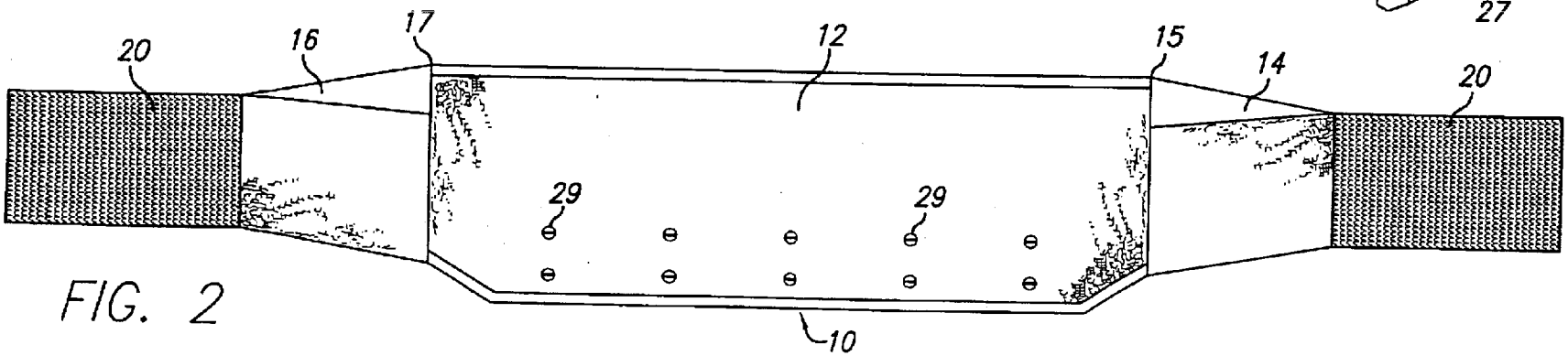
FIG. 2 schematically shows a rear view of said belt.

Referring to the FIGS, the harness of the present invention comprises a unitary waist-encircling supportive belt 10 of largely elastic fabric adapted to receive and securely hold paintball pods 25. In the preferred embodiment, elastic fabric is fabricated from a woven or knit elastic, such as an appropriate product selected from the offerings of Lea & Sachs, Inc., Des Plaines, Ill., <http://www.leasachs.com>. An inner layer of fabric 12 connects with first and second elastic flaps 14, 16 which extend outwardly in opposite directions and terminate in a VELCRO fastening system 20, 22. VELCRO fasteners, manufactured by Velcro Industries, B.V., Amsterdam, Netherlands, comprise male fastening hook elements 20 on the outer surface of the flaps, as shown in FIG. 1, in conjunction with female fastening elements 22 of VELCRO which are formed of a plurality of generally spaced apart non-overlapping, upstanding monofilamentary loop elements on the inner surface of the flaps, as shown in FIG. 2, which, when brought in contact, engage the hook elements 20. A plurality of retainer clips 24, best shown in FIG. 1A and sometimes referred to herein as "pod stops", are equidistantly arranged on the outwardly facing surface of said inner layer 12, said retainer clips 24 being secured to inner layer 12 by rivets 29 passing through rivet holes 28 therein. The retainer clips 24 comprise a vertical back 26 joining a horizontal ledge 27 at the lower edge thereof, with holes 28 in the back portion 26 to accommodate said rivets 29.

Figure 3:
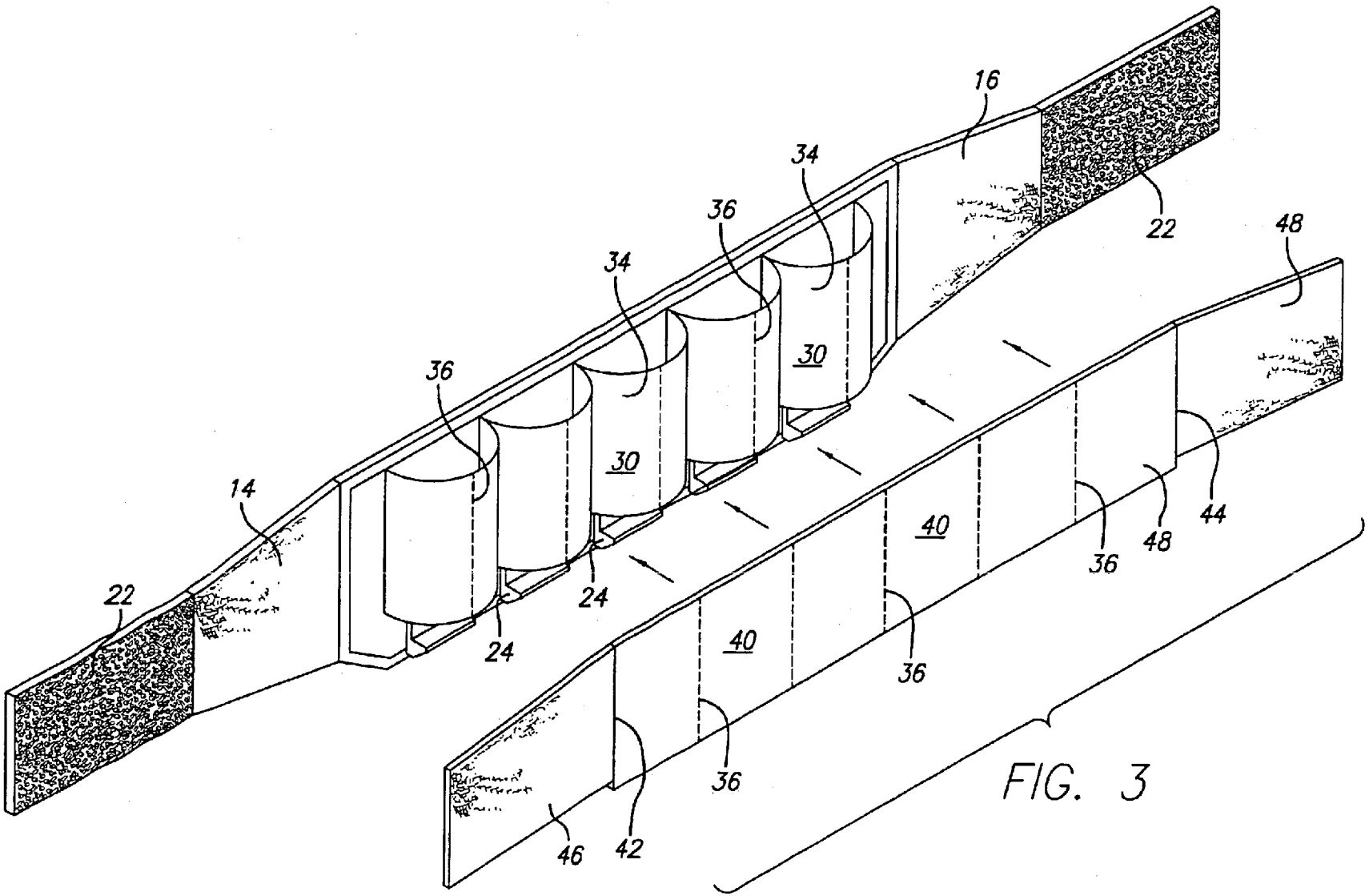
FIG. 3 is an exploded view of the harness, illustrating the positioning of the outer fabric layer with respect to the intermediate and inner fabric layers.
Figure 4:
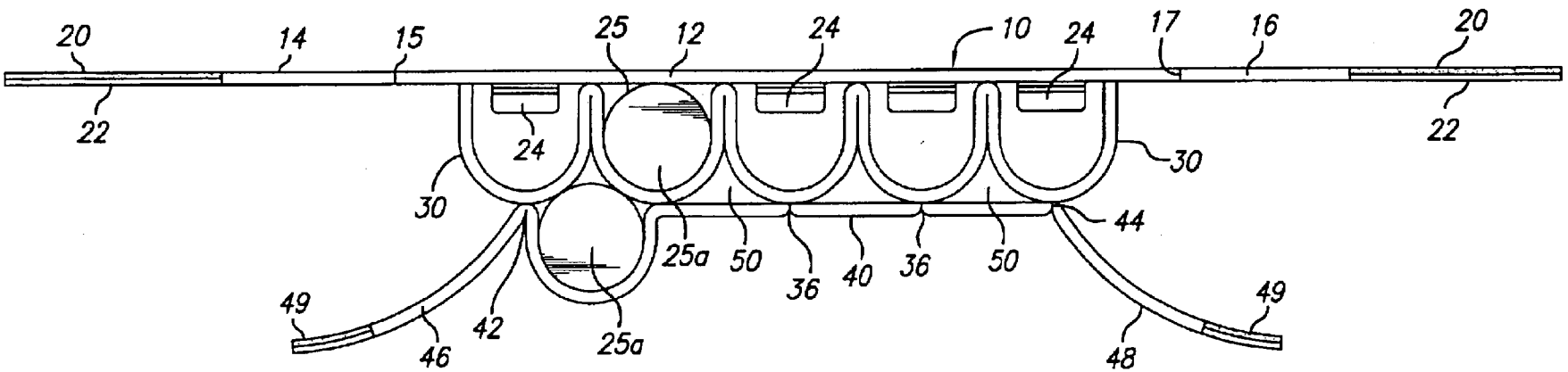
FIG. 4 is a top view illustrating the interconnection of the several components of the present invention to form a harness adapted to receive and secure paintball pods, showing several paintball pods placed therein.

Referring now to FIGS. 3 and 4, an intermediate layer 30 of elastic material, longer in length but shorter in height than said inner layer 12, is arranged upon said inner layer between the locations of said retainer clips 24 to form hollow pockets 34 which, together with said clips 24, conform to the configuration of and, when stretched, securely hold, inserted paintball pods 25 (see FIG. 1). An outer layer of elastic fabric 40 is joined at its outer ends 42,44 connecting with first and second flaps 46, 48 which extend outwardly in opposite directions. The end surfaces of said flaps 46, 48 which face the flaps 14, 16 of the inner layer 12, comprise VELCRO hooks 49 to engage with the VELCRO loops 22 of the inner layer 12 when the harness 10 is in a collapsed position. The outer layer 40 of elastic fabric is longitudinally secured to each hollow pocket 34 at an intermediate position thereon 36, illustrated in FIG. 3 as stitching, thereby forming a plurality of additional or secondary hollow pockets 50 (see FIG. 4) formed by the outer layer 40 and the intermediate layer 30. The outer layer flaps 46, 48 can be adjusted by the wearer to increase the compression on the pods 25, or loosened to carry more pods, as the circumstances require. The resulting configuration will accommodate a plurality of paintball pods 25 of various sizes and affords the advantage that, as the wearer exhausts and discards pods, the belt tends to contract and the wearer becomes less encumbered.

It is seen that the preferred embodiment of the present invention comprises harness carrier 10 in the form of a waist encircling belt means which can accommodate from a single pod to nine pods, at the wearer's option, although the harness carrier could be constructed to accommodate a larger or smaller number without departing from the teaching of the present invention. While some prior art pod carriers employ elastic loops and are expandable, in the present instance the entire harness 10 is a unitary, one-piece, structure which expands when pods 25 are inserted in the pockets 34, 50 and collapses as pods 25 are removed. By employment of VELCRO hooks 20, 49 at the extremities of the flaps 14, 16, 46, 48, said flaps may be tightened around the waist of the wearer to connect with the VELCRO loops 22, and once appropriately adjusted, apply pressure upon and secure the pods 25 arranged within the pockets 34, 50 (see FIG. 4). Consequently, as the pods 25 are removed and discarded in the course of play, each pocket in which the pods are arranged will collapse and the belt 10 contracts accordingly.

The employment of pod stops 24, in cooperation with the other aspects of the present invention, is also believed to be unique. Prior art pod carriers are known to employ VELCRO straps attached to a belt, said straps extending from the belt, under the pod, to be secured on an outer surface of the belt, to keep the pod in place. To remove a pod, the VELCRO strap must be removed, in the course of which a noise is generated, thereby providing means to identify the physical location of the wearer. Further, the carrier harness does not collapse. By way of contrast, the placement of pod stops 24 within the pockets 34 formed by the inner and intermediate elastic fabric layers 12, 30 enhances the security of the pods 25 until deployment, the clip ledge 27 serving to ensure the closure of the pod flip-up lid 25*a* which is in bearing relation thereto.

In the preferred embodiment, the inner layer 12 is an inelastic fabric, although other inelastic or elastic materials could be employed. Further, while some of the honeycomb of pockets 34, 50 are shown in FIGS. 3 and 4 to be extended as if to accommodate the peripheral dimensions of inserted pods 25, it is to be understood that, as the pockets are formed by elastic materials 30, 40, they would form a waist-encircling belt of increasingly lesser circumferential dimension as pods 25 were withdrawn therefrom.

What is claimed:

1. A collapsible paintball carrier assembly comprising:

a. A waist-encircling belt having an interior and exterior surface, first and second end sections, and a midsection between said end sections;

b. An intermediate fabric layer of greater length and shorter height than said belt, said fabric layer having an inner and outer surface and being positioned above, and secured to, said belt exterior surface at junction points on said midsection to form a honeycomb of hollow pockets adapted to receive inserted paintballs;

c. An exterior fabric layer having first and second end sections and a midsection between said end sections, said exterior fabric layer being secured at intermediate junction points on the outer surface of said hollow pockets formed by said belt and intermediate fabric layer to form a second honeycomb of hollow pockets adapted to receive inserted paintballs;

d. Tensioning means arranged at the first and second end sections of said belt; and e. Tensioning means arranged at the first and second end sections of said exterior fabric layer, whereby a compressive force is impressed upon paintballs inserted in said hollow pockets when said tensioning means are engaged.

2. The collapsible paintball carrier assembly of claim 1 wherein said fabric layers are of elastic material.

3. The collapsible paintball carrier assembly of claim 1 wherein said tensioning means comprise a looped weave-hook system.

4. The collapsible paintball carrier assembly of claim 1 wherein the midsection of said waist-encircling belt comprises an inelastic material.

5. The collapsible carrier assembly of claim 1 wherein said midsection of said waist-encircling belt comprises an elastomeric material.

6. The collapsible paintball carrier assembly of claim 1 further comprising a pod retainer clip arranged on the outer surface of the belt within at least one of the hollow pockets formed by the belt and intermediate fabric layer.

7. The collapsible paintball carrier assembly of claim 4 wherein said pod retainer clip comprises a horizontal ledge joined to a vertical back member at the lower edge thereof, whereby closure of a flip-up lid of an inserted paintball pod is assured.

8. A unitary waist-encircling supportive harness adapted to receive and securely hold paintball pods of differing circumferences comprising:

A belt;

Flap members affixed to each end of said belt, said flap members terminating in a material having a continuously looped, brushed polyester weave on the outer surface thereof;

A plurality of retainer clips secured upon the outer surface of said belt;

A fabric layer of greater length but shorter height than said belt positioned over said retainer clips secured upon outer surface of said belt, said fabric layer being secured to said belt outer surface at junction points and intermediate points thereof between the positions of the retainer clips to form a plurality of expansible hollow pockets which, in concert with said clips assume the circumferential configuration of and securely hold inserted paintball pods;

Another fabric layer;

Flap members affixed to each end of said other fabric layer, said flap members terminating in a material having a plurality of upstanding hook elements on the inner surface thereof for engagement with said continuously looped brushed polyester weave for attachment onto said belt flap members;

Said other fabric layer being secured to the exterior of each hollow pocket at an intermediate position thereon, thereby forming an additional plurality of expansible hollow pockets;

Whereby the outer circumference of said waist-encircling supportive belt expands as pods are inserted and contracts as the pods are removed.

9. The unitary waist-encircling supportive harness of claim 8, wherein said belt and said fabric layers comprise an elastic cloth.

10. The unitary waist-encircling supportive harness of claim 9 wherein said retainer clips comprise a horizontal ledge joined to a vertical back member at the lower edge thereof.

11. The unitary waist-encircling harness of claim 10 wherein said belt comprises an inelastic material.

12. A unitary waist-encircling supportive harness adapted to receive and securely hold paintball pods comprising:

An inner layer of fabric, having an inner and outer surface;

First and second flap members, each joined to said inner layer at an outer end thereof, said first and second flap members extending outwardly in opposite directions;

A pair of VELCRO hook-receiving surfaces positioned at the terminal ends of said first and second flap members;

A plurality of retainer clips equidistantly arranged on the outer surface of said inner layer;

Rivet members securing said retainer clips to said inner fabric layer;

An intermediate layer of elastic fabric, longer in length but shorter in height than said inner fabric layer, said intermediate layer being arranged upon the outer surface of said inner layer and secured at junction and intermediate points on said outer surface of said inner layer between said retainer clips, thereby forming hollow pockets which, together with said clips are adapted to assume the configuration and securely hold in alignment and compression, paintball pods inserted therein;

An outer layer of elastic fabric;

Third and fourth flap members, each joined to said outer fabric layer at an end thereof, said third and fourth flap members extending outwardly in opposite directions;

A pair of VELCRO hook surfaces positioned at the terminal ends of said third and fourth flap members;

Said outer fabric layer being secured to the exterior surface of each hollow pocket at an intermediate position thereon, thereby forming a second plurality of hollow pockets formed by said outer fabric layer and the exterior surface of said intermediate fabric layer;

thereby forming a honeycomb of expansible pockets accommodating paintball pods of varying circumferential dimensions.

* * * * *